US005806209A

United States Patent [19]

Crowley et al.

[11] Patent Number: 5,806,209

[45] Date of Patent: Sep. 15, 1998

[54] CUSHIONING SYSTEM FOR A SHOE

[75] Inventors: Kevin J. Crowley, Brentwood; Craig F. Fram, Plaistow, both of N.H.; Sean B. Murphy, Medford, Mass.

[73] Assignee: Fila U.S.A., Inc., Sparks, Md.

[21] Appl. No.: 705,814

[22] Filed: Aug. 30, 1996

[51] Int. Cl.[6] ..... A43B 13/04; A43B 13/12; A43B 13/14

[52] U.S. Cl. ..... 36/28; 36/31; 36/103

[58] Field of Search ..... 36/28, 31, 25 R, 36/30 R, 32, 92, 103

[56] References Cited

U.S. PATENT DOCUMENTS

| | | | |
|---|---|---|---|
| 613,789 | 12/1898 | Powell | 36/32 R |
| 4,353,553 | 10/1982 | Derderian et al. . | |
| 4,608,768 | 9/1986 | Cavanagh . | |
| 4,614,046 | 9/1986 | Dassler . | |
| 4,817,304 | 4/1989 | Parker et al. . | |
| 4,833,795 | 5/1989 | Diaz . | |
| 4,881,329 | 11/1989 | Crowley . | |
| 4,910,886 | 3/1990 | Sullivan et al. . | |
| 5,005,300 | 4/1991 | Diaz et al. . | |
| 5,046,267 | 9/1991 | Kilgore et al. . | |
| 5,092,060 | 3/1992 | Frachey et al. . | |
| 5,131,173 | 7/1992 | Anderie | 36/30 R |
| 5,255,451 | 10/1993 | Tong et al. . | |
| 5,279,051 | 1/1994 | Whatley . | |
| 5,282,288 | 2/1994 | Henson . | |
| 5,343,639 | 9/1994 | Kilgore et al. . | |
| 5,353,523 | 10/1994 | Kilgore et al. . | |
| 5,369,896 | 12/1994 | Frachey et al. . | |
| 5,384,973 | 1/1995 | Lyden . | |
| 5,435,078 | 7/1995 | Pyle . | |
| 5,440,826 | 8/1995 | Whatley . | |
| 5,544,429 | 8/1996 | Ellis, III | 36/25 R |

FOREIGN PATENT DOCUMENTS

| | | | |
|---|---|---|---|
| 411330 | 2/1991 | European Pat. Off. | 36/28 |
| 867443 | 10/1941 | France | 36/31 |
| 2676918 | 12/1992 | France | 36/25 R |
| WO 96/18317 | 6/1996 | WIPO . | |

*Primary Examiner*—Paul T. Sewell
*Assistant Examiner*—Anthony Stashick
*Attorney, Agent, or Firm*—Fish & Richardson P.C.

[57] ABSTRACT

A shoe cushioning system having a thin midsole, a first forefoot element, a second forefoot element and a heel element is described. The first forefoot element is connected to the midsole near the front of the forefoot region, the second forefoot element is connected to the midsole near the rear of the forefoot region, and the heel element is connected to the midsole in the heel region. The first and second forefoot elements are separated by a flex zone. The first forefoot element, second forefoot element and heel element each comprise an elastically deformable cushion with substantially planar top and bottom sides, and an attached cap structure. The first forefoot element may have a curved front edge and a substantially linear rear edge, wherein the curved front edge approximately follows the curved line defined by the metatarsal heads of the metatarsus bones of the foot. In addition, the second forefoot element may have a curved rear edge approximately in the region of the proximal ends of the metatarsals of the metatarsus bones of the foot.

16 Claims, 5 Drawing Sheets

CUSHIONING SYSTEM FOR A SHOE

BACKGROUND OF THE INVENTION

This invention relates to footwear having a cushioning system. The cushioning system provides increased stability, durability and rebound in a shoe.

The modern athletic shoe is a combination of many elements which have specific functions, all of which must work together for the support and protection of the foot. Athletic shoes today are varied in design and purpose depending on their intended use. For example, tennis shoes, racquetball shoes, basketball shoes, running shoes, baseball shoes, football shoes, weightlifting shoes, and walking shoes are all designed for use in very specific and different ways. Each shoe type provides a unique and specific combination of traction, support and protection for the foot to enhance performance. Sports shoes may also be designed to meet the specific characteristics of the user. For example, there are different shoes for persons that are heavier or lighter, for persons having wide feet or narrow feet, and for persons having high arches or low arches.

FIG. 9 is a representation of the skeletal framework 50 of the human foot, which provides the requisite strength to support the weight of the body during many activities. The foot consists of 26 interconnected bones, categorized into three main groups: the phalanges 52 (the distal group), the metatarsus 62 (the middle group), and the tarsus 72 (the posterior group). Although many of the joints between these bones are attached by ligaments and are thus relatively inflexible, there are a number of movable joints that are important to foot flexibility and stability.

The leg bones (the tibia and fibula, not shown) are movably connected to the talus 77 of the foot to form the ankle joint. The hinge-type joint formed by these bones allows both dorsi flexion (upward movement) and plantar flexion (downward movement) of the foot. The talus 77 overlies and is movably interconnected to the calcaneus 78 (heel bone) to form the subtalar joint, which enables the foot to move in a generally rotative, side-to-side motion. The outward and inward motion of the foot during walking or running is associated with this movement about the subtalar joint.

The metatarsus 62 is comprised of metatarsals 63–67 which are relatively long bones that extend forwardly across the middle part of the foot, articulating the tarsus 72 and phalanges 52. Each of the metatarsals are aligned with and articulate to one of the phalanges. For example, the first metatarsal 63 has a metatarsal head 63*a* which articulates to the hallux (or big toe) at the proximal phalange of the hallux 53*a*, and the fifth metatarsal 67 has a metatarsal head 67*a* which articulates to the proximal phalanx 57*a* of the fifth or smallest digit. The first, second and third metatarsals 63–65 are attached at their proximal ends to the outer, middle and inner cuneiforms 73–75, respectively. The proximal ends of the fourth and fifth metatarsals 66,67 articulate to the cuboid 76.

The phalanges 52 comprise fourteen bones 53*a*–57*c* which are associated with the toes, and are hingedly attached to the metatarsals 63–67 for significant movement. The movements of these bones in the foot play an integral role in controlling pronation and supination of the foot, which are discussed below. In particular, the hallux 53 or big toe is the prominent toe for supporting weight, providing propulsive force and for stabilizing the foot.

A shoe is divided into two general parts, an upper and a sole. The upper is designed to comfortably enclose the foot, while the sole provides traction, protection and a durable wear surface. The considerable forces generated by running require that the sole of a running shoe provide enhanced protection and shock absorption for the foot and leg. It is also desirable to have enhanced protection and cushioning for the foot and leg in all types of footwear. Accordingly, the sole of a running shoe typically includes several layers, including a resilient shock absorbing or cushioning layer as a midsole and a ground contacting outer sole or outsole which provides both durability and traction. This is particularly true for training or jogging shoes designed to be used over long distances and over a long period of time. The sole also provides a broad, stable base to support the foot during ground contact.

Different materials in different configurations have been used in the midsole to improve cushioning and to provide effective foot control. Some shoes use materials of different hardness to provide cushioning and foot control. These types of shoes have the disadvantage of a short life due to breakdown of the materials used to form the midsole. For example, many shoes use only ethyl vinyl acetate (EVA) for cushioning. The cells of this foam tends to break down during use, virtually eliminating the usefulness of the midsole. This in turn can cause serious injuries.

During running, the heel strikes the ground followed by the ball of the foot. As the heel leaves the ground, the foot rolls forward until the toes make contact, and then the entire foot leaves the ground to begin another cycle. When the foot is in contact with the ground, it typically rolls from the outside or lateral side to the inside or medial side, a process called pronation. Consequently, the outside of the heel usually strikes first and the toes on the inside of the foot typically leave the ground last. While the foot is in the air and preparing for another cycle the opposite process, called supination, which is a rolling of the foot from the medial to the lateral side, occurs. Over-pronation, an excessive inward roll of the foot when in contact with the ground, can be a potential source of foot and leg injury. Soft cushioning materials in the midsole may provide protection against impact forces, but they can also encourage instability of the subtalar joint, thereby contributing to the tendency for over-pronation. This instability has been cited as a contributor to "runners knee" and other athletic injuries.

Various stability devices for resisting excessive pronation and supination, or instability of the ankle, have been incorporated into prior art athletic shoes. In general, these devices have been fashioned by modifying conventional shoe components, such as the heel counter, and by modifying the midsole cushioning materials. Although some degree of success in controlling pronation and/or supination was demonstrated, the devices generally add to the weight and manufacturing expense of the shoe.

SUMMARY OF THE INVENTION

A shoe cushioning system is presented having a thin midsole, a first forefoot element, a second forefoot element and a heel element. The first forefoot element is connected to the midsole near the front of the forefoot region, the second forefoot element is connected to the midsole near the rear of the forefoot region, and the heel element is connected to the midsole in the heel region. The first and second forefoot elements are separated by a forefoot flex zone. The first forefoot element, second forefoot element and heel element are independent of each other, and comprise an elastically deformable cushion with substantially planar top and bottom sides, and an attached cap structure.

Preferred embodiments include the following features. The first forefoot element may have a curved front edge and a substantially linear rear edge, wherein the curved front edge approximately follows the curved line defined by the metatarsal heads of the metatarsus bones of the foot. In addition, the second forefoot element may have a curved rear edge in the area of the forefoot defined by the proximal ends of the metatarsals of the metatarsus bones of the foot. Further, the forefoot flex zone may be a substantially linear channel disposed at an angle of 13–15 degrees from an imaginary horizontal line drawn laterally through the sole.

The cushioning system may also include a toe cap structure attached to the midsole in the toe region. A curved flex zone is located between the toe cap structure and the first forefoot element, and approximately follows the curved line defined by the metatarsal heads of the metatarsus bones of the foot.

The cushioning system may also comprise a transfer element connected to the midsole in the arch region of the foot between the second forefoot element and the heel element. A cap structure is connected to the transfer element. A first zone between the transfer element and the second forefoot element, and a second zone between the transfer element and the heel element provide an appropriate level of torsional rigidity in the arch area of the foot.

The cushioning system may also comprise a stabilization element attached to the midsole near the heel region, and a cap structure connected to the stability element.

Advantages of the present invention include providing an improved cushioning system that provides enhanced stability for a runner or walker. In addition, the sole is more durable and lightweight than prior art shoe soles. Further, the independent cushioning system may be used in conjunction with other cushioning or rear foot control devices, and may be easily incorporated into existing and future athletic shoe designs.

DETAILED DESCRIPTION

Figure 1:
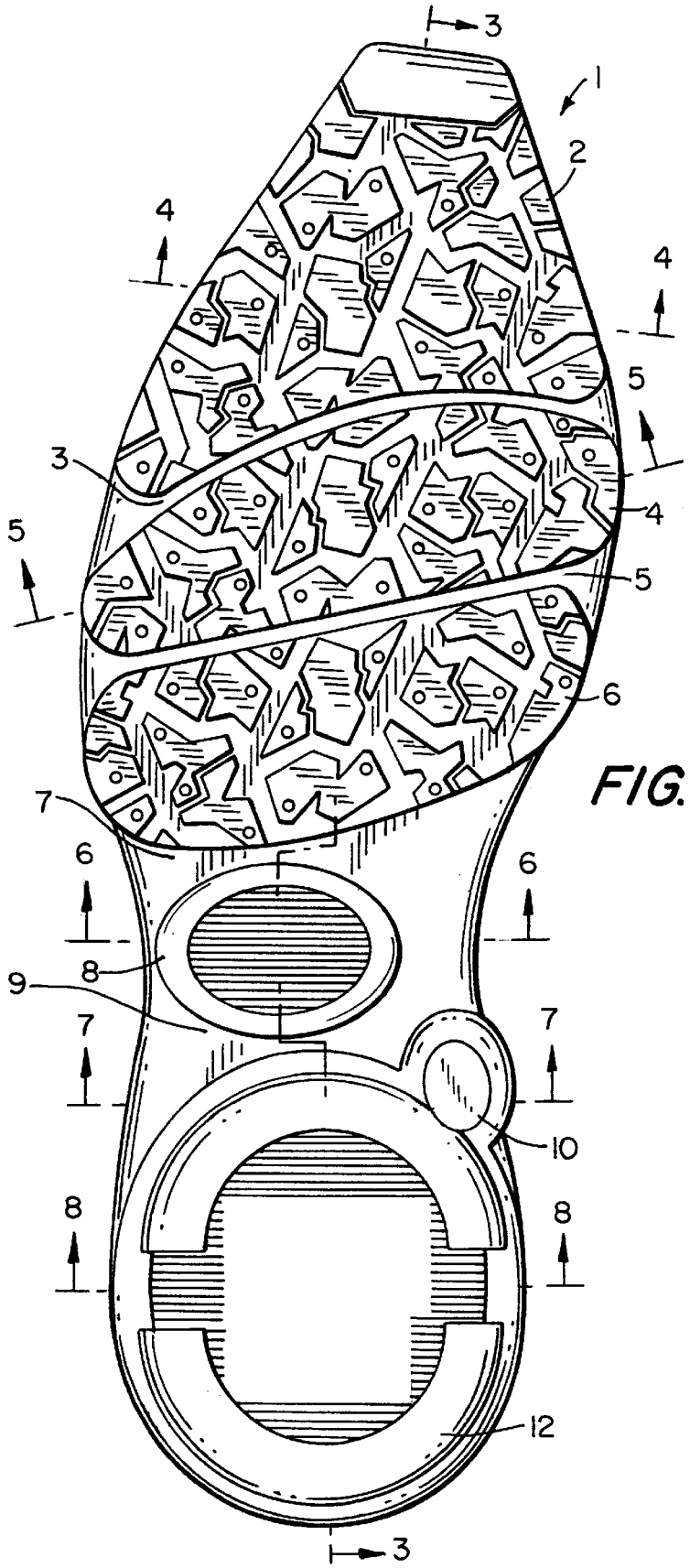
FIG. 1 is a bottom view of an embodiment of the shoe sole cushioning system.

FIG. 1 is a bottom view of the sole of an embodiment of a cushioning system 1 for a shoe according to the invention. A toe element 2, a first forefoot element 4, a second forefoot element 6, a transfer element 8, a stabilization element 10 and a heel element 12 are shown. The toe element and first forefoot element are separated by a curved flex zone 3, the first and second forefoot elements are separated by a forefoot flex zone 5, the second forefoot element and transfer element 8 are separated by a first zone 7, and the transfer element and the heel element are separated by a second zone 9.

Figure 9:
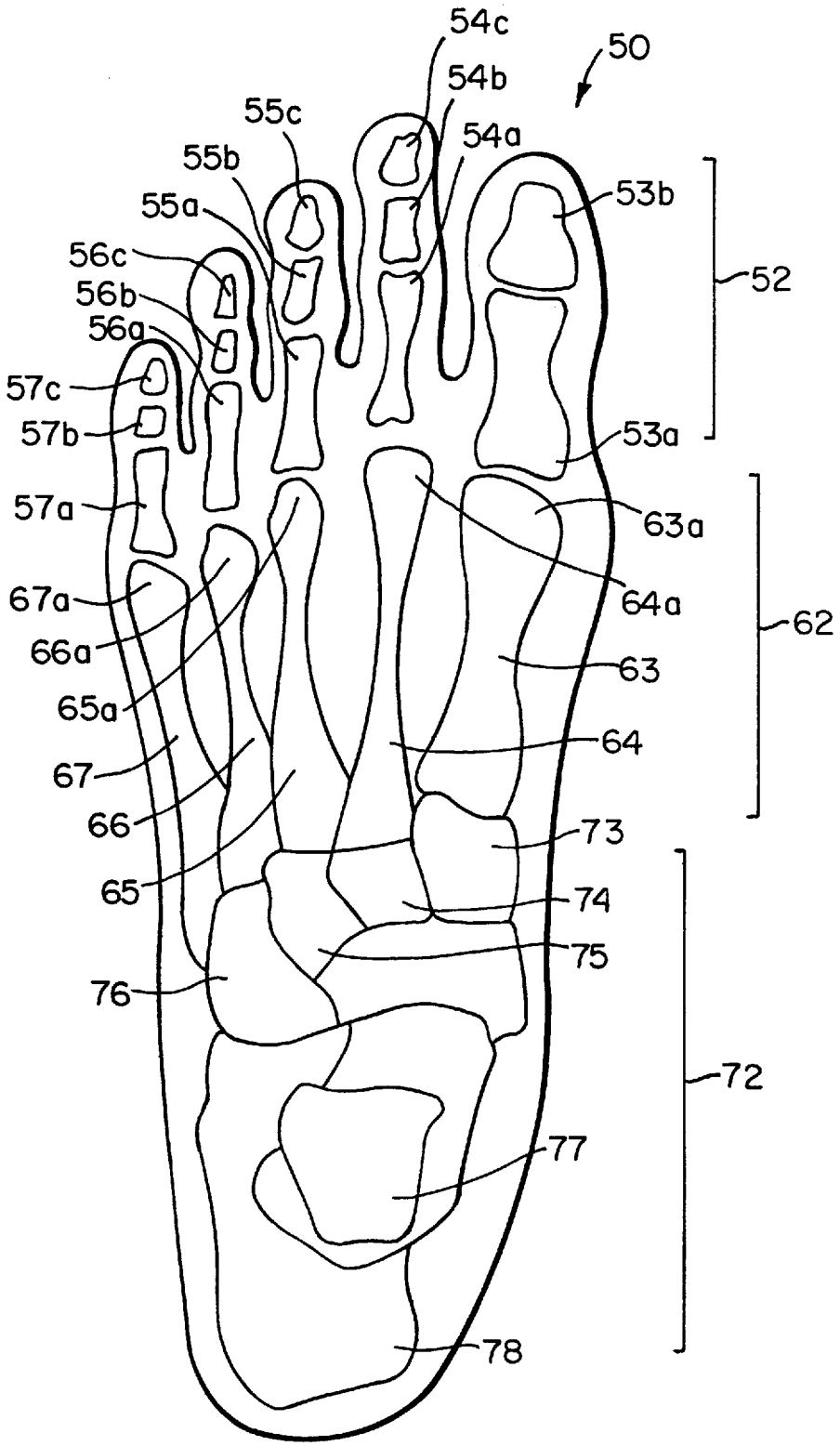
FIG. 9 is a representation of the skeletal framework of the human foot.

The curvature of both the front edge of the first forefoot element 4 and the curved flex zone 3 approximately matches the curved line defined by the metatarsal heads 63*a*–67*a* of the metatarsus bones 62 (see FIG. 9). Therefore, as the wearer of the shoe walks or runs, the shoe sole flexes or bends along the curved flex zone to emulate the actual flex angle of the metatarsal heads.

The forefoot flex zone 5 also permits flexing of the shoe sole in the metatarsus region. In particular, the forefoot flex zone extends across the sole at an angle of at least 10 degrees from an imaginary horizontal line G—G drawn laterally through the sole. The angle of the forefoot flex zone may differ for different shoe types, and may depend on the sport for which the shoe will be worn. For example, for a running shoe the forefoot flex zone is preferably at an angle of from 13 to 15 degrees from line G—G, as shown in FIG. 1.

The rear edge of the second forefoot element 6 is curved in the area of the forefoot defined by the proximal ends of the metatarsals 63–67 of the metatarsus bones of the foot (see FIG. 9). A first zone 7 separates the second forefoot element from the transfer element 8, and a second zone 9 separates the heel element 12 from the transfer element 8. The first and second zones 7, 9 provide an appropriate level of torsional rigidity for the sole in the arch region of the foot.

Figure 2:
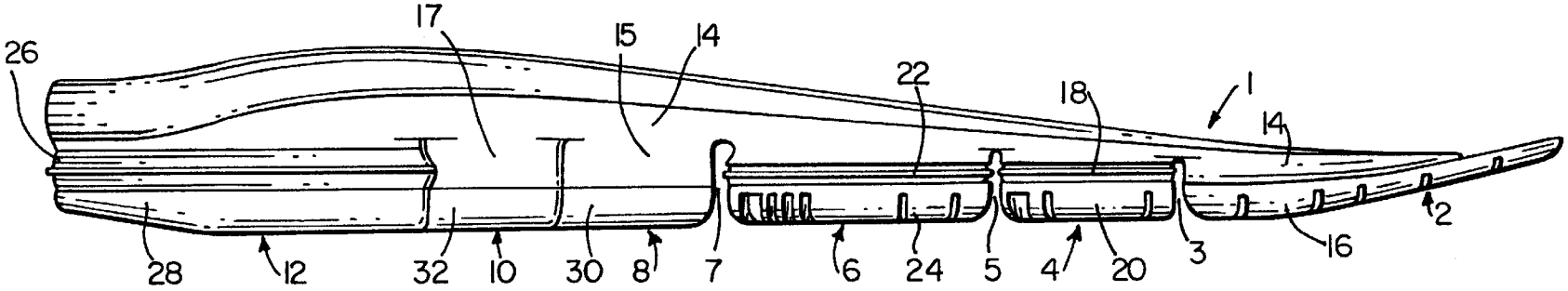
FIG. 2 is a medial side view of the sole of FIG. 1.

FIG. 2 is a medial side view of the cushioning system 1 of FIG. 1. A thin midsole 14, preferably composed of EVA or a polyurethane (PU) material, forms a base for the cushioning system. An important feature of the present invention is that the EVA or PU material of the midsole is greatly reduced in comparison to typical athletic shoes, and is not relied upon to provide much cushioning for the foot. This feature enables the sole to be longer wearing than that found on typical athletic shoes.

Referring to FIG. 2, the toe element 2 comprises a toe cap structure 16 connected to the midsole 14. To the rear of the toe element is the curved flex zone 3 which is a deep channel, on the order of 12–14 millimeters (mm) deep measured from the edge of the toe cap 16 that contacts a surface to the midsole. The first forefoot element 4 comprises an elastically deformable first cushion 18 and a first cap element 20, and has a curved front edge and a substantially linear rear edge. Directly behind the rear edge of the first forefoot element 4 is the forefoot flex zone 5, which is approximately 10 mm deep, and separates the first and second forefoot elements 4,6 as shown. The second forefoot element 6 is comprised of an elastically deformable second cushion 22 and a second cap element 24.

The heel element 12 is comprised of an elastically deformable heel cushion 26 and a heel cap 28. The transfer element 8 (see also FIGS. 1 and 3) comprises a transfer cap 30 attached to transfer region 15 which may be built up from the material of the midsole. Similarly, the stability element 10 (see also FIG. 2) comprises a stability cap 32 attached to a stability region 17 which may be built up from the material of the midsole. The toe cap structure 16, first cap element 20, second cap element 24, heel cap 28, transfer cap 30 and stability cap 32 are preferably comprised of a durable rubber material and may contain notches or incisions to improve traction.

Figure 3:
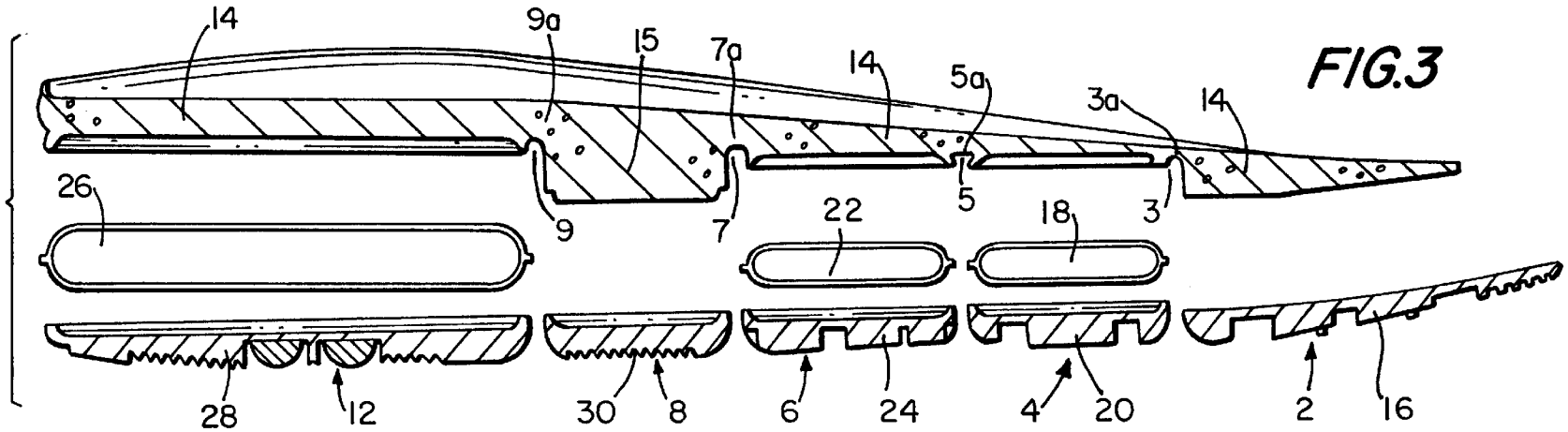
FIG. 3 is an exploded cross-sectional view of the sole of FIG. 2 taken along dotted line A—A of FIG. 1.

FIG. 3 is an exploded cross-sectional view of the sole of FIG. 2 taken along dotted line A—A of FIG. 1. The first cushion 18, second cushion 22 and heel cushion 26 are shown in relation to the midsole 14 and their respective cap elements 20, 24 and 28. The first cushion 18, second cushion 22 and heel cushion 26 are preferably comprised of a plurality of elastically deformable, uniformly spaced elements of substantially similar height and diameter. The deformable elements are preferably made of a thermoplastic material enclosed in an air-tight casing constructed of a plastic material such as polyurethane or other similar material. Such cushion elements are disclosed in U.S. Pat. Nos. 5,092,060 and 5,369,896 which are assigned to the assignee of the present application, and which are incorporated in their entirety by reference herein.

FIG. 3 illustrates that overall, the midsole 14 is relatively thin in comparison to prior art midsoles. Further, the midsole is thin in each of the regions containing the cushion elements 18, 22 and 26, and contains channels 3*a*, 5*a*, 7*a* and 9*a*. In particular, in area 3*a* above the curved flex zone the midsole 14 is only about 2 mm thick. Thus, the curved flex zone operates as a hinge in the area of the metatarsal heads 63*a*–67*a* of the foot (see FIG. 9) to permit the sole to bend as a wearer walks or runs. The hinging action takes place high in the midsole, close to the foot to advantageously offer a sole bending action that mimics the natural forefoot flexing motion of the phalanges 52 and metatarsus 62 bones of the foot. In like manner, the midsole is thin in channel areas 5*a*, 7*a* and 9*a* corresponding to the forefoot flex zone 5 and the first and second zones 7, 9. In particular, the midsole is approximately 4–5 mm thick in area 5*a*, 6–7 mm thick in area 7*a*, and about 7 mm thick in area 9*a*. Thus, the midsole exhibits improved bending action along the flex zones of the cushioning system 1, to provide a more natural foot flexing motion and forefoot flexibility for a walker or runner.

Figure 4:
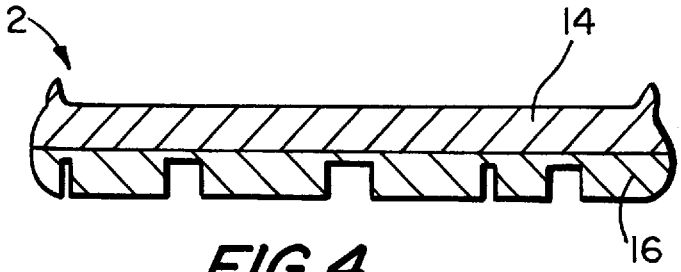
FIG. 4 is a cross-sectional view taken along line B—B of the sole of FIG. 1.

FIGS. 4–8 are cross-sectional views taken along lines A—A to F—F of FIG. 1. In particular, FIG. 4 is a cross-sectional view of the toe element 2 taken along dotted line B—B of FIG. 1. As shown, the toe cap structure 16 is connected directly to the midsole 14.

Figure 5:
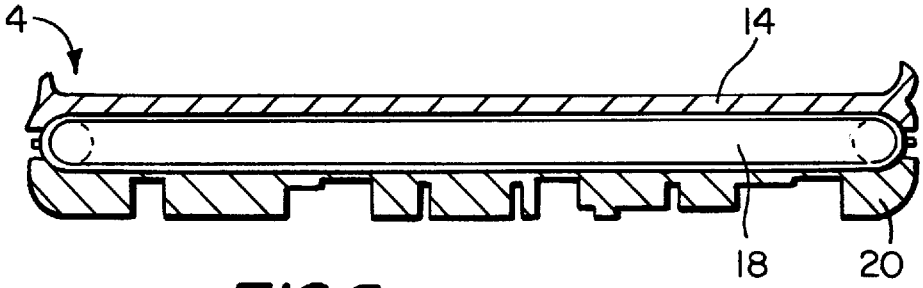
FIG. 5 is a cross-sectional view taken along dotted line C—C of the sole of FIG. 1.

FIG. 5 is a cross-sectional view of the first forefoot element 4 taken along dotted line C—C of FIG. 1. The first cap element 20 is attached to the first cushion 18 which is attached to the midsole 14. As shown, the midsole 14 is thin in the region of the first forefoot element 4, between 2–5 mm thick, and thus the first cushion 18 provides the majority of the cushioning. The second forefoot element 6 is constructed in the same manner, the second cushion 22 provides most of the cushioning, and the midsole in this region is approximately between 5–8 mm thick.

Figure 6:
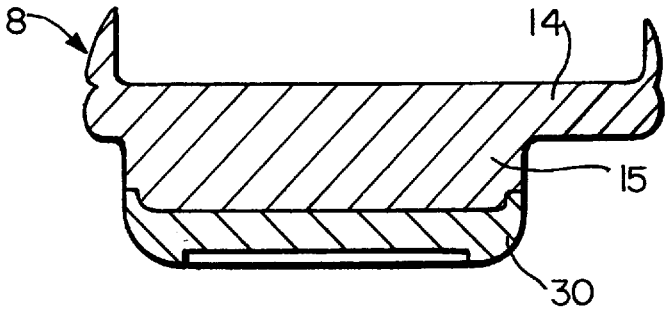
FIG. 6 is a cross-sectional view taken along dotted line D—D of the sole of FIG. 1.

FIG. 6 is a cross-sectional view of the transfer element 8 taken along dotted line D—D in FIG. 1. The transfer element is comprised of a region 15, which may be of the same material as the midsole 14, attached to a transfer cap 30. Thus, the transfer element 8 may be comprised primarily of EVA or PU material, and the transfer cap 30 has a relatively small contact area in comparison to those of the cap elements of the first forefoot element 4, second forefoot element 6 and heel element 12 (see FIG. 1). The transfer element 8 provides arch support for the foot, and contacts the surface during the walking or running motion to transfer the motion from the heel area to the forefoot.

Figure 7:
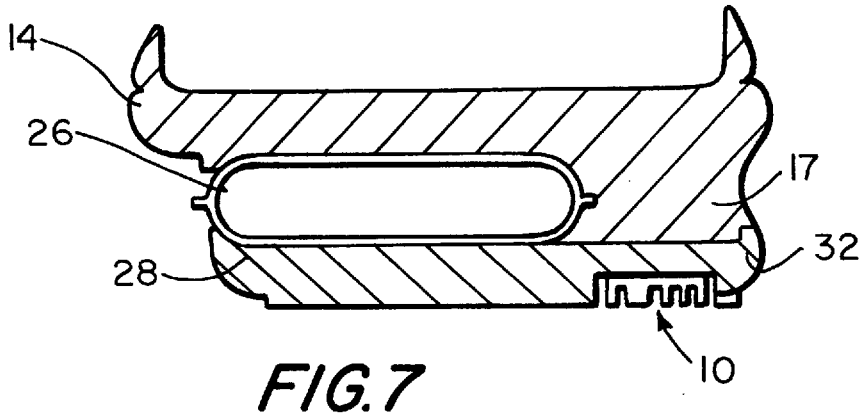
FIG. 7 is a cross-sectional view taken along dotted line E—E of the sole of FIG. 1.

FIG. 7 is a cross-sectional view of the stability element 10 and part of the heel element 12 taken along dotted line E—E of FIG. 1. The stability element comprises a stability cap 32, which may be an extension of the heel cap 28, attached to a region 17 of the midsole 14. Like the transfer element 8, the stability element 10 may be comprised primarily of EVA or PU material, and the stability cap has a small contact area. The stability element does not provide cushioning, but rather functions to contact the surface to aid in stabilizing the foot of some runners who exhibit a tendency to excessively pronate after heel strike.

Figure 8:
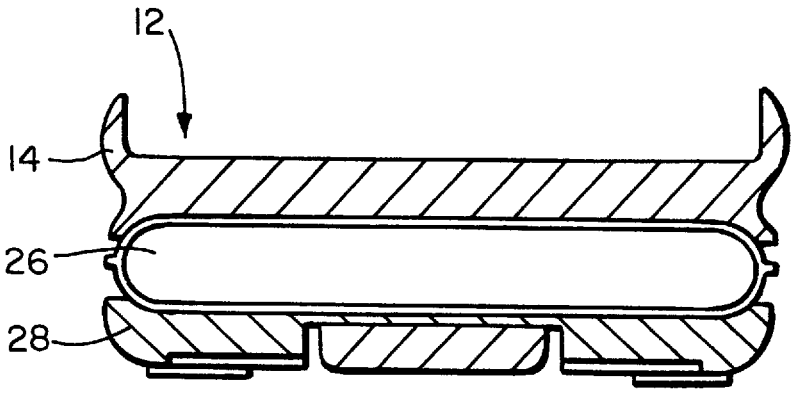
FIG. 8 is a cross-sectional view taken along dotted line F—F of the sole of FIG. 1.

FIG. 8 is a cross-sectional view of the heel element 12 taken along dotted line F—F of FIG. 1. The heel cap 28 is connected to the heel cushion 26 which is connected to the midsole 14. The midsole is approximately 8 mm thick in the heel area, however, the heel cushion 26 provides the majority of the cushioning during heel strike.

The first forefoot element 4, the second forefoot element 6 and the heel element 12 form the cushioning system according to the invention. Each of the cushioning elements is independently connected to the midsole, and each reacts to surface conditions independently of the others during walking or running. Thus, each cushioning element provides independent suspension for the foot. In particular, during running, as the heel element 12 strikes a surface the heel cushion 26 operates to absorb the impact forces from the runners' foot while also providing a stable platform for the runner. The stability element 10 contacts the surface with more or less force depending on the foot motion of the runner. At this time the forefoot elements are not in contact with the surface. As the foot follows through its rolling motion towards the toes, the transfer element 8 contacts the surface to transfer the movement to the second forefoot element 6. The second forefoot element 6, then the first forefoot element 4, and then the toe element 2 contact the surface before the foot becomes airborne. The curved flex zone 3, forefoot flex zone 5, first zone 7 and second zone 9 permit the sole to bend and torque to mimic the natural undulating motion of the foot.

The heel cushion and the first and second forefoot cushions of the cushioning system 1 absorb the vast majority of the impact of the foot while running. Therefore, the first, second and heel cap elements 20, 24, 28 can be made of an unusually hard, high abrasion rubber material. Such cap elements provide traction, and are exceptionally durable to provide a long wearing outer sole surface for the shoe.

The above discloses a preferred embodiment of the invention, however, other variations and combinations utilizing the concepts taught herein may be used. Moreover, various other embodiments, alterations and changes will be apparent to one skilled in the art, and may be made without deviating from the spirit of the invention as defined by the appended claims.

What is claimed is:

1. A shoe cushioning system, comprising:

a thin midsole having a reduced thickness toe region, a reduced thickness forefoot region, an arch region and a reduced thickness heel region;

a first forefoot element connected to the midsole near the front of the reduced thickness forefoot region, the forefoot element comprising an elastically deformable first cushion with substantially planar top and bottom sides, a front edge and a rear edge and an attached cap structure;

a second forefoot element connected to the midsole near the rear of the reduced thickness forefoot region and separated from the first forefoot element by a forefoot flex zone formed by a channel in the midsole to enable a hinging action to permit a natural foot flexing motion, the second forefoot element comprising an elastically deformable second cushion with substantially planar top and bottom sides, a front edge and a rear edge and an attached cap structure; and a heel element connected to the reduced thickness heel region of the midsole, the heel element comprising an elastically deformable heel cushion with substantially planar top and bottom sides and an attached heel cap structure;

wherein the first, second and heel cushions react independently to surface conditions and absorb the majority of the impact of a foot, and contain a plurality of elastically deformable and uniformly spaced elements of substantially similar height and diameter.

2. The cushioning system of claim 1, wherein the front edge of the first forefoot element is curved to approximately follow the curved line defined by the metatarsal heads of the metatarsus bones of the foot.

3. The cushioning system of claim 1, wherein the rear edge of the second forefoot element is curved in the area of the forefoot defined by the proximal ends of the metatarsals of the metatarsus bones of the foot.

4. The cushioning system of claim 1, wherein the forefoot flex zone is a substantially linear channel disposed at an angle of at least 10 degrees from an imaginary horizontal line drawn laterally through the sole.

5. The cushioning system of claim 1, further comprising a toe cap structure attached to the midsole in the toe region.

6. The cushioning system of claim 5, further comprising a curved flex zone between the toe cap structure and the first forefoot element.

7. The cushioning system of claim 6, wherein the curved flex zone approximately follows the curved line defined by the metatarsal heads of the metatarsus bones of the foot.

8. The cushioning system of claim 1, further comprising a transfer element connected to the midsole in the arch region between the second forefoot element and the heel element, and a cap structure connected to the transfer element.

9. The cushioning system of claim 8, further comprising a first zone between the transfer element and the second forefoot element, and a second zone between the transfer element and the heel element.

10. The cushioning system of claim 1, further comprising a stability element attached to the midsole near the heel region, and a cap structure connected to the stability element.

11. The cushioning system of claim 1, wherein the thin midsole is composed from one of EVA and Polyurethane.

12. The cushioning system of claim 1, wherein the forefoot flex zone has a depth of approximately 10 millimeters.

13. The system of claim 12, wherein the first forefoot element has a thickness of 2 to 5 millimeters and the second forefoot element has a thickness of 5 to 8 millimeters.

14. The cushioning system of claim 6, wherein the curved flex zone has a depth of approximately 12 to 14 millimeters.

15. A method for constructing a shoe sole cushioning system, comprising:

providing a thin midsole having a reduced thickness toe region, a reduced thickness forefoot region, an arch region and a reduced thickness heel region;

connecting a first forefoot element to the front of the reduced thickness forefoot region of the midsole, the first forefoot element comprising an elastically deformable first cushion;

connecting a second forefoot element to the rear of the reduced thickness forefoot region of the midsole, the second forefoot element comprising an elastically deformable second cushion;

separating said first and second forefoot elements with a forefoot flex zone formed by a channel in the midsole that enables a hinging action to permit a natural foot flexing motion; and connecting a heel element to the reduced thickness heel region, the heel element having an elastically deformable third cushion;

wherein the first, second and third cushions react independently to surface conditions and absorb the majority of the impact of a foot, and contain a plurality of elastically deformable and uniformly spaced elements of substantially similar height and diameter.

16. The method of claim 15 further comprising providing a curved flex zone disposed between the first forefoot element and the toe region.

* * * * *